US005511284A

United States Patent [19]

Current

[11] Patent Number: 5,511,284

[45] Date of Patent: Apr. 30, 1996

[54] DOOR HOLD OPEN DEVICE

[75] Inventor: Andrew Current, Oglesby, Ill.

[73] Assignee: Schlage Lock Company, San Francisco, Calif.

[21] Appl. No.: 453,305

[22] Filed: May 30, 1995

[51] Int. Cl.[6] ..... E05F 3/00; E05F 5/02; E05C 3/06; E05B 65/10

[52] U.S. Cl. ..... 16/82; 16/DIG. 7; 16/49; 292/201; 292/144; 292/92

[58] Field of Search ..... 16/82, 49, DIG. 7, 16/79; 292/201, 144, 92

[56] References Cited

U.S. PATENT DOCUMENTS

| | | | |
|---|---|---|---|
| 3,864,875 | 2/1975 | Hewitt | 49/115 |
| 3,964,125 | 6/1976 | Tansley | 16/48.5 |
| 4,086,681 | 5/1978 | Nakanishi | 16/49 |
| 4,878,265 | 11/1989 | Nesbitt | 16/49 |
| 4,979,261 | 12/1990 | Lasier et al. | 16/79 |
| 5,048,150 | 9/1991 | Guerin | 16/49 |
| 5,048,151 | 9/1991 | Orii et al. | 16/49 |
| 5,131,115 | 7/1992 | Sarto | 16/82 |
| 5,142,735 | 9/1992 | Konishi | 16/82 |

*Primary Examiner*—Daniel W. Howell
*Assistant Examiner*—Adesh Bhargava
*Attorney, Agent, or Firm*—Keith F. Noe; Robert F. Palermo

[57] ABSTRACT

A door hold open device is disclosed for maintaining a door swingably mounted on a door jamb in an open position. The door hold open device includes an elongate track housing mounted on the door jamb, and a shaft disposed within the track housing. The shaft extends along a horizontal axis and is mounted for free rotation about the axis. A slider block having a threaded bore threadably engages a threaded portion of the shaft. The slider block is capable of moving linearly along the horizontal axis and causes the axial rotational movement of the shaft as it moves linearly from side-to-side. An arm link is pivotally connected at one of its ends to the slider block and pivotally connected at its other end to the door. The arrangement is such that upon manually opening and closing the door, the arm link moves the slider block linearly from side-to-side thereby causing the axial rotational movement of the shaft. A clutch mechanism is disposed adjacent the shaft and is selectively engagable with a non-threaded end of the shaft for preventing the rotation of the shaft thereby locking the slider block in a stationary position for maintaining the door in an open position.

8 Claims, 3 Drawing Sheets

DOOR HOLD OPEN DEVICE

BACKGROUND OF THE INVENTION

The invention generally relates to powered door operators and controls, and more particularly to a door hold open device which maintains a door swingably mounted on a door jamb in an open position.

In hospitals and other health care facilities (e.g., nursing homes), it is sometimes desirable to open a door and leave it open at a predetermined angle of rotation. One common way of accomplishing this is by securing a door stop between the bottom of the door and the floor whereby the door stop prevents the door from closing. A problem associated with this method of keeping the door open is that it is sometimes difficult to reach down and secure the door stop underneath the door. Another disadvantage is that it is impossible to automatically close the door in emergency situations (e.g., a fire) because the door stop requires manual removal.

Another common way of keeping the door open is by incorporating a hold open mechanism into the door closer assembly which is provided for closing the door after it has been opened. Such mechanisms are often difficult to incorporate into the door closer assembly. There are also cost considerations which make the assembly of the door closer and hold open mechanism impractical. Moreover, there is a need for a hold open device which can be assembled with existing door closer assemblies.

The foregoing illustrates limitations known to exist in present door hold open devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door hold open device for maintaining a door swingably mounted on a door jamb in an open position. The door hold open device comprises an elongate track housing mounted on the door jamb along a generally horizontal axis, and a shaft disposed within the track housing. The shaft has a threaded middle portion and non-threaded outer end portions. The shaft extends along the horizontal axis and is mounted for free rotation about the axis. A slider block having a threaded bore threadably engages the threaded portion of the shaft. The slider block is adapted to move linearly along the horizontal axis and causes the axial rotational movement of the shaft as it moves linearly from side-to-side. An arm link is pivotally connected at one of its ends to the slider block and pivotally connected at its other end to the door. The arrangement is such that upon manually opening and closing the door, the arm link moves the slider block linearly from side-to-side thereby causing the axial rotational movement of the shaft. A clutch mechanism is disposed adjacent the shaft and is selectively engagable with a non-threaded end of the shaft for preventing the rotation of the shaft thereby locking the slider block in a stationary position for maintaining the door in an open position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
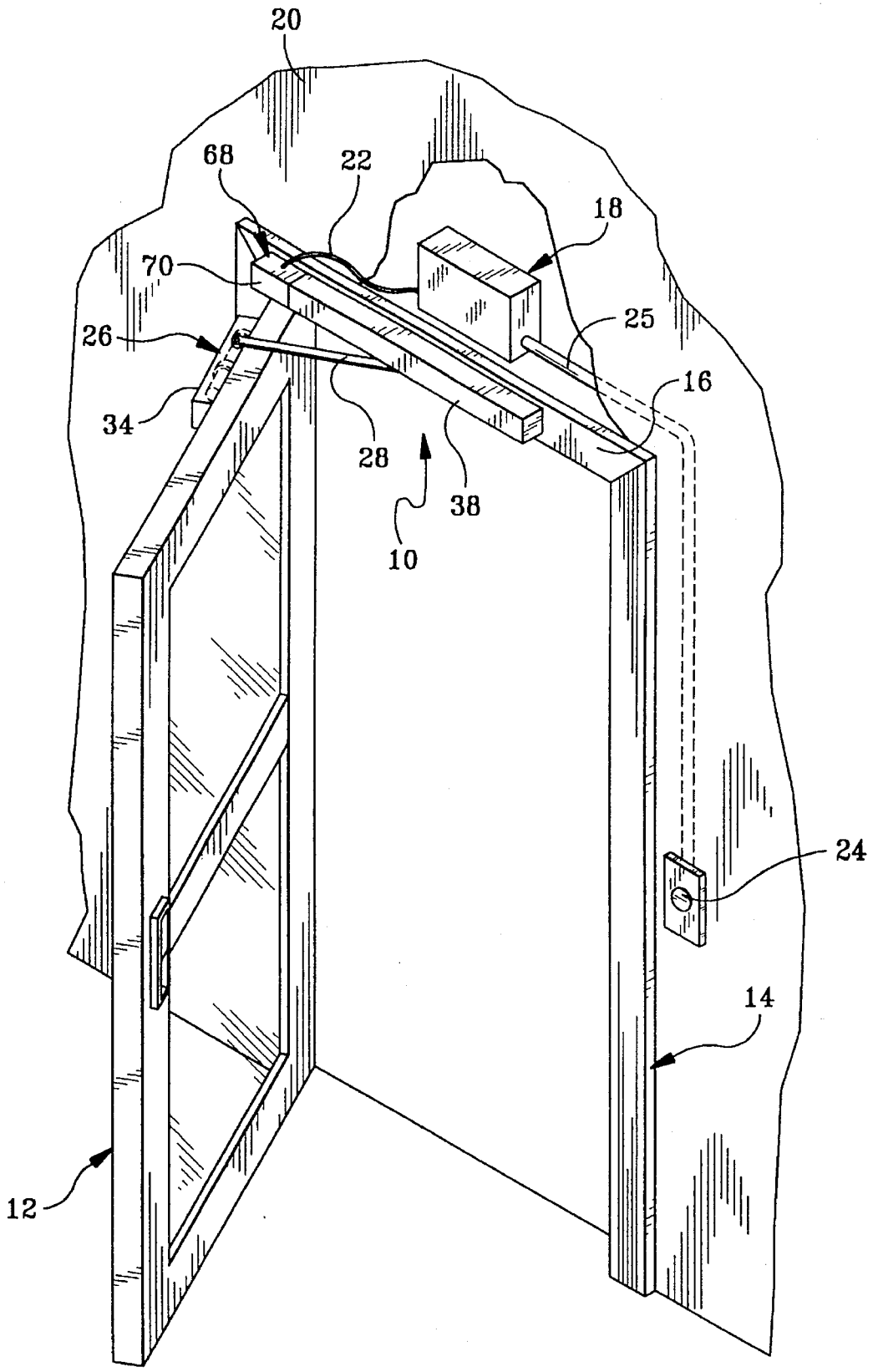
FIG. 1 is a perspective, environmental view with portions removed of a door hold open device of the present invention for keeping a door swingably mounted on a door jamb in an open position.

Referring now to the drawings, wherein similar reference characters designate corresponding parts throughout the several views, the embodiment of the apparatus shown in FIG. 1 comprises a door hold open device 10 according to one embodiment of the invention. More specifically, the door hold open device 10 is provided for maintaining a door, generally indicated at 12, swingably mounted (e.g., by hinges) on a door jamb, generally indicated at 14, in an open position. The door hold open device 10 is preferably installed in hospitals and other facilities where it is desired to maintain the door 12 in an open position.

FIG. 1 illustrates the door hold open device 10 of the present invention mounted on the top door jamb member 16 for maintaining the door 12 in an open position. It should be noted that the door hold open device 10 instead of being mounted on the exterior of the top door jamb member 16 can be mounted within the top door jamb member 16, or the door 12, if it is desired to have it concealed. The door hold open device 10 is in electrical communication with a control device, generally indicated at 18, which is housed interiorly within a wall 20 on which the door jamb 14 is mounted. The control device 18 may alternatively be provided within the ceiling or other suitable location. The control device 18 includes a suitable microprocessor for controlling the door hold open device 10 to maintain the door 12 in open position. In the shown embodiment, the control device 18 is in electrical communication with the door hold open device 10 by a wire 22. The specific connections of the arrangement of these components will be discussed in greater detail below and may vary depending on the type of control device used. Also, it should be noted that the control device 18 need not be provided and that the door hold open device 10 can operate independently without a control. This aspect of the present invention will also be discussed in greater detail below.

A switch 24 is mounted on the wall 20 adjacent the door jamb and is in electrical communication with the control device 18 via wire 25 for selectively keeping the door 12 open when desired. The arrangement is such that a person, such as a doctor or nurse, for example, desiring to maintain the door 12 in an open position need only press the switch 24 for activating the control device 18 which in turn activates the door hold open device for locking the door 12 in a desired open position. It should be understood that the arrangement depicted in FIG. 1 of the drawings is but an example of the many different embodiments envisioned for the door hold open device 10. For example, another type of switch or sensor can be used to detect the presence of someone entering or leaving the room which triggers the control device 18 for maintaining the door 12 in an open position.

The door hold open device 10 of the present invention is designed for working in concert with a manual door closer assembly, generally indicated at 26, which is connected to the door hold open device 10 by a closer arm link 28. The arrangement is such that after the door 12 is opened via the arm link 28, the door closer assembly 26 provides a closing force on the arm link 28 to close the door 12. The door closer assembly 26 is of standard construction and capable of providing a closing force on the door 12 when it is in an open position. As shown, the door closer assembly 26 is mounted on the door 12 adjacent its upper edge. One end of the arm link 28 is pivotally attached to the pinion shaft 32 of the door closer assembly 26 which is mounted on the door 12 by screw fasteners (not shown). The housing 34 includes a compression spring mechanism 36 illustrated in broken lines in FIG. 2 for providing a torsional force on the pinion shaft 32 and the arm link 28 which is sufficient for closing the door 12 when it is in an open position. The compression spring mechanism 36 drives the arm link 28 by means of the pinion shaft 32 and applies a moment force on the arm link 28 in the clockwise direction (as illustrated in FIG. 3) for closing the door 12. The housing 34, along with the other component parts of the door closer assembly 26, may be fabricated from rigid metal, such as steel. This construction of the door closer assembly 26 is well-known in the art of door closer assemblies and the arrangement in FIGS. 1–3 may embody other constructions and still fall within the scope of the present invention.

Figure 2:
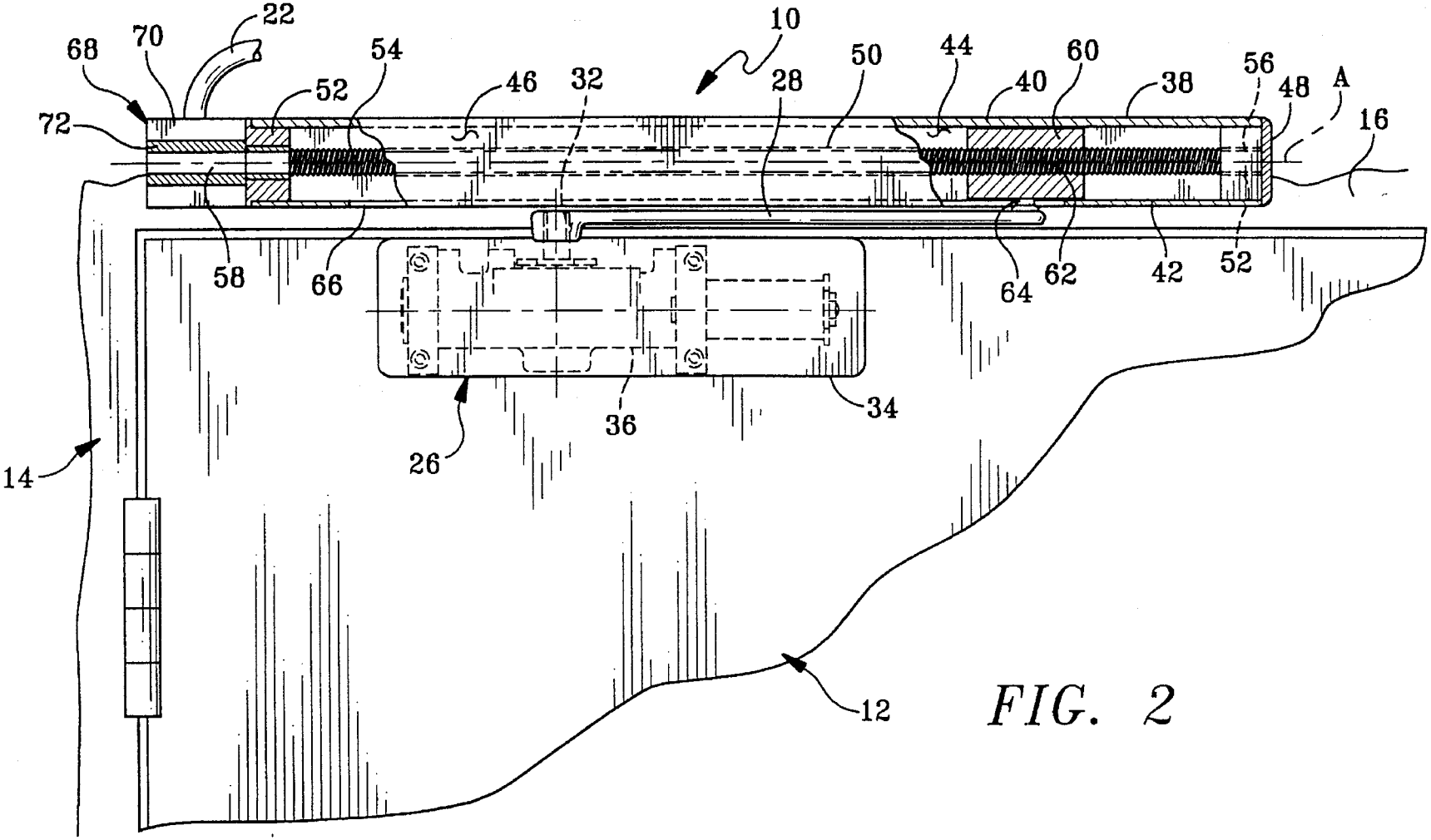
FIG. 2 is an enlarged, partial cross section elevational view of the door hold open device illustrated in FIG. 1.
Figure 3:
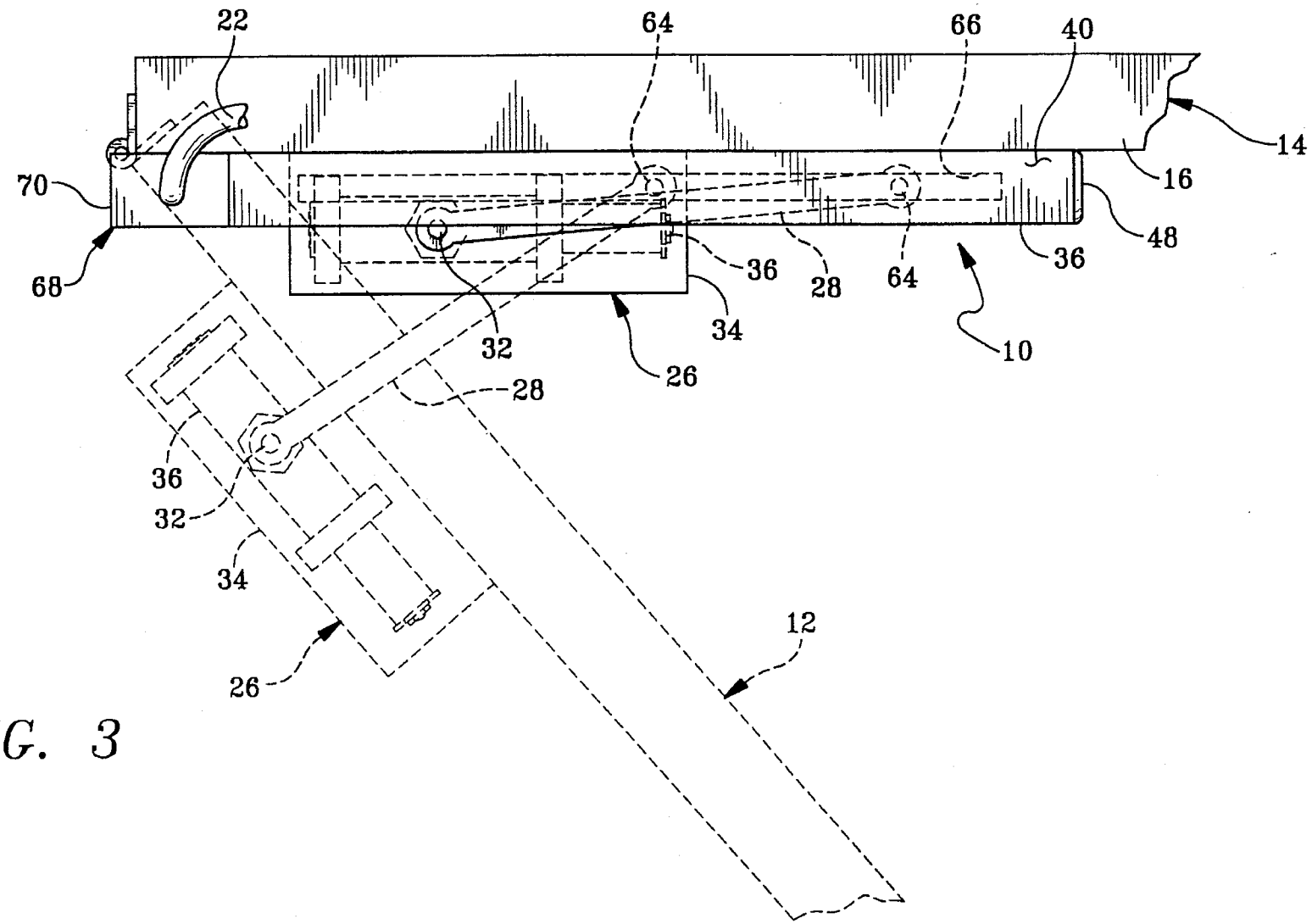
FIG. 3 is a top plan view with portions removed of the door hold open device illustrating the door in broken lines in an opened position.

Turning now to FIGS. 2 and 3, the door hold open device 10 comprises an elongate track housing 38 mounted on the top door jamb member 16 along a generally horizontal axis A. The track housing 38 is rectangular in construction and comprises a top wall 40, a bottom wall 42, a rear wall 44 which is placed adjacent the door jamb when mounting the track housing thereto, a front wall 46 and a right-hand end wall 48. The track housing 38 may also be fabricated from steel along with the other components of the door hold open device 10.

As shown in FIG. 2, the door hold open device 10 further includes a shaft 50 mounted within the interior of the track housing 38 by a pair of bearings, each designated 52. The shaft 50 has a threaded middle portion 54 and two opposite non-threaded end portions 56, 58 which are engaged and supported by the bearings. As illustrated in FIG. 2, the right-hand bearing 52 is positioned adjacent the end wall 48 of the track housing 38 and supports the right-hand end portion 56 of the shaft 50. Similarly, the left-hand bearing 52 is positioned at the left-hand side of the track housing 38 and supports the left-hand end portion 58 of the shaft 50. The bearings 52 supporting the shaft 50 are well-known and can be chosen from any number of commercial suppliers of bearings. The bearings 52 enable the shaft 50 to freely rotate about the horizontal axis A when a rotational force is applied on the shaft 50.

A slider block 60 having a threaded bore 62 is mounted on the threaded middle portion 54 of the shaft 50 in a position where the threaded portion 54 is threadably received in the threaded bore 62 of the slider block 60. The slider block 60 is sized for being received in the interior of the track housing 38 without interfering with the walls 40, 42, 44 and 46 thereof. The closer arm link 28 is pivotally connected to the slider block 60 by another pin 64. The slider block 60 is capable of moving linearly back-and-forth within the interior of the track housing 38 along the shaft 50. The bottom wall 42 of the track housing 38 has an elongate slot 66 formed therein through which the pin 64 projects thereby enabling the slider block 60 to move without the pin 64 interfering with the bottom wall 42 of the track housing 38. Alternatively, the bottom wall 42 can be eliminated from the track housing 38 altogether whereby the pin 64 can extend through the open bottom of the track housing 38. It should be noted that as the slider block 60 is moved linearly from side-to-side along the horizontal axis A, it causes the shaft 50 to rotate about the axis A.

A clutch mechanism, generally indicated at 68, is mounted at one end of the track housing 38 by any suitable manner (e.g., as by welding or by bolt fasteners). The clutch mechanism 68 is selectively engagable with the non-threaded end portion 58 of the shaft 50 for preventing the rotation of the shaft 50. The locking force applied on the shaft 50 is sufficient to prevent the door closer assembly 26 from closing the door 12. Once engaged by the clutch mechanism 68, the slider block 60 is locked in a stationary position for maintaining the door 12 in an open position since the shaft 50 cannot rotate. The clutch mechanism 68 once disengaged from the shaft 50 allows the shaft 50 to rotate which enables the door closer assembly 26 to close the door 12 whereby the slider block 60 moves linearly to its right-hand position shown in FIG. 2. As illustrated in FIGS. 1 and 2, the clutch mechanism 68 includes a housing 70 attached to the track housing 38 and a roller clutch bearing 72 supported by the clutch housing 70. The roller clutch bearing 72 prevents the relative rotation of the clutch mechanism 68 and the shaft 50 when it is desired to maintain the door 12 in its open position and can be purchased from a number of suppliers of "one-way" or "over-running clutches". When the clutch mechanism 68 disengages the roller clutch bearing 72, relative rotation between the clutch mechanism 68 and shaft 50 is allowed thus allowing the door closer assembly 26 to close the door 12.

As mentioned above, the control device 18 is suitably connected to the clutch mechanism by wire 22 for providing the electrical communication between the two components and powering the operation of the clutch mechanism 68. More specifically, the clutch mechanism 68 is activated by the control device 18 upon the switch 24 being pressed. The arrangement is such that the control device 18 can be programmed to keep the door 12 open at any of a number of predetermined angles of rotation. Of course, in such an arrangement, a sensor (not shown) located within the track housing 38 is provided in order to determine the location of the slider block 60 with respect to the shaft 50 for determining the door 12 angle. Also, the control device 18 can be programmed to override the clutch mechanism 68 and disengage it from the shaft 50 upon the occurrence of a certain event, such as a fire. In the shown embodiment, the door 12 would maintain its present angle of rotation upon pressing the switch 24.

During operation of the door hold open device 10, a person wishing to maintain the door 12 in an open position must open the door 12 and press the switch 24 on the wall 20 adjacent the door 12. Upon pressing the switch 24, the control device 18 activates the clutch mechanism 68 which prevents the shaft 50 from rotating. This locks the slider block 60 and maintains the door 12 in open position. The roller clutch bearing 72 of the clutch mechanism 68 can be designed to be overridden either by the control device 18 or by a person applying a closing force on the door 12 whereby the roller clutch bearing 72 slips and a sensor triggers to de-energize the clutch and enables the door 12 to be closed by door closer assembly 26. Also, once energy delivered to the clutch mechanism 68 by the control device 18 is cut-off (e.g., after a predetermined amount of time or by pressing the switch again), the clutch mechanism 68 disengages the shaft 50 thereby allowing the door closer assembly 26 to close the door 12. It should be noted that a mechanically controlled clutch may be used rather than an electrically controlled clutch.

For a door hold open device 10 which operates independently without the aid of the control device 18, the clutch mechanism 68 engages the shaft 50 after opening the door 12 from its closed position for maintaining the door 12 in an open position. The roller clutch bearing 72 enables the clutch mechanism 68 to perform this function. The arrangement is such that the clutch mechanism 68, and more particularly the roller clutch bearing 72, can be overridden by applying a nominal closing force on the door 12 whereby the roller clutch bearing 72 disengages the shaft 50 and allows the door closer assembly 26 to close the door 12.

It should be noted that the door hold open device 10 is simple in construction and cost-efficient in manufacture and in installation. Moreover, the door hold open device 10 is compatible with existing door closer assemblies and may be installed in retrofit situations.

While this invention has been illustrated and described in accordance with a preferred embodiment, it is recognized that variations and changes may be made therein without departing from the invention as set forth in the following claims.

Having described the invention, what is claimed is:

1. A door hold open device for maintaining a door swingably mounted on a door jamb in an open position, said door hold open device comprising:

an elongate track housing mounted on the door jamb along a generally horizontal axis;

a shaft disposed within the track housing, said shaft having a threaded middle portion and non-threaded outer end portions, said shaft extending along said horizontal axis and being mounted for free rotation about said axis;

a slider block having a threaded bore threadably engaging said threaded portion of the shaft, said slider block being adapted to move linearly along said horizontal axis and causing the axial rotational movement of said shaft as it moves linearly from side-to-side;

an arm link pivotally connected at one of its ends to the slider block and pivotally connected at its other end to the door, the arrangement being such that upon manually opening and closing the door, the arm link moves the slider block linearly from side-to-side thereby causing the axial rotational movement of the shaft; and a clutch mechanism disposed adjacent the shaft, said clutch mechanism being selectively engagable with a non-threaded end of said shaft for preventing the rotation of the shaft thereby locking said slider block in a stationary position for maintaining the door in an open position.

2. A door hold open device as set forth in claim 1 further comprising a control for controlling the selective engagement of the clutch mechanism with said shaft, said control being adapted to maintain the clutch in engagement with the shaft for preventing the linear movement of the slider block from side-to-side along said shaft thereby maintaining the door in a selected opened position, and being adapted to disengage the clutch mechanism from the shaft for allowing the door to move to its closed position.

3. A door hold open device as set forth in claim 2, said control being in electrical communication with a switch for selectively maintaining said door in an open position.

4. A door hold open device as set forth in claim 1, said clutch mechanism comprising a roller clutch bearing which prevents the relative rotation of the clutch mechanism and the shaft when it is desired to maintain the door in its open position and allows the relative rotation of the clutch mechanism and the shaft when it is desired to close the door.

5. A door hold open device as set forth in claim 1 further comprising a door closer assembly pivotally attached to the arm link for providing a closing force on the door, said door closer assembly having a housing mounted on said door, and means for providing a closing force on the arm link contained within said housing of the door closer assembly for closing the door when it is an open position and said clutch mechanism is disengaged from said shaft.

6. A door hold open device as set forth in claim 1, said clutch mechanism being mounted at one end of the track housing.

7. A door hold open device as set forth in claim 1, said shaft being supported by a pair of spaced-apart bearings which are mounted on the interior of the track housing.

8. A door hold open device as set forth in claim 1, further comprising:

means for sensing rotary motion of said shaft and for triggering the release of the clutch holding force on said shaft.

* * * * *